US008719977B2

(12) United States Patent
Rabbany et al.

(10) Patent No.: US 8,719,977 B2
(45) Date of Patent: May 13, 2014

(54) EXPANDABLE MATTRESS COVER

(76) Inventors: Farhad Rabbany, Vernon, CA (US); Faramarz Yadegari, Vernon, CA (US)

( * ) Notice: Subject to any disclaimer, the term of this patent is extended or adjusted under 35 U.S.C. 154(b) by 0 days.

(21) Appl. No.: 13/312,112

(22) Filed: Dec. 6, 2011

(65) Prior Publication Data

US 2013/0139316 A1 Jun. 6, 2013

(51) Int. Cl.
*A47G 9/04* (2006.01)
*A47G 9/02* (2006.01)

(52) U.S. Cl.
USPC ..... 5/500; 5/499; 5/496; 5/498; 5/502

(58) Field of Classification Search
USPC ..... 5/482, 485, 486, 488, 495, 496–502, 5/504.1, 692, 698, 699
See application file for complete search history.

(56) References Cited

U.S. PATENT DOCUMENTS 6,618,880 B1 * 9/2003 Chase ..... 5/500
6,971,130 B2 * 12/2005 Chase ..... 5/500
2008/0028522 A1 * 2/2008 Atwood ..... 5/496
2008/0178386 A1 * 7/2008 Thompson ..... 5/485
2008/0250561 A1 * 10/2008 Poston ..... 5/499
2010/0154122 A1 * 6/2010 Crispino et al. ..... 5/636
2012/0137434 A1 * 6/2012 Dusaj ..... 5/499
2012/0167301 A1 * 7/2012 Michael ..... 5/482

* cited by examiner

*Primary Examiner* — William Kelleher
*Assistant Examiner* — David R Hare
(74) *Attorney, Agent, or Firm* — Michael N. Cohen; Cohen I.P. Law Group P.C.

(57) ABSTRACT

An expandable mattress cover comprises a top sheet, a bottom sheet and a sidewall joining the top sheet and the bottom sheet. A plurality of edges of the sidewall is stitched to the top sheet and the bottom sheet to form a compartment. An expandable means having a hook is attached to the sidewall. An opening is provided on the sidewall for inserting a mattress into the compartment. The expandable means may be adjusted to fit mattresses of different thicknesses inside the expandable mattress cover. A fastening means with a hook is adjusted to open the opening before inserting a mattress into the compartment. The mattress is secured in position by adjusting the fastening means to a closed position. The hook is used to clip the expandable means and the fastening means onto the sidewall.

6 Claims, 4 Drawing Sheets

EXPANDABLE MATTRESS COVER

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to mattress covers and more particularly to an expandable mattress is cover for covering mattresses of different thickness.

DISCUSSION OF RELATED ART

Several types of mattress covers are widely used by people for covering mattresses to prevent soiling, dirt and damage to the mattress. Mattresses having various size and thickness are available in the market. The existing mattress covers may not be suitable for effectively covering mattresses of different size and thicknesses. Mattresses having thickness between 4 to 18 inches are very common in the market and the existing mattress covers cannot be expanded and contracted to fit with these mattresses.

U.S. Pat. Application No. 20100154122 entitled to Crispino on Jun. 24, 2010, describes a bed covering system. The bed covering system comprises an upper sheet and a lower sheet. The lower sheet fits on a mattress in a removable manner. The upper sheet is connected to the lower sheet through expandable flaps of material. A zipper runs between the sides of the upper and lower sheets such that when it is zipped, the upper sheet is pulled tightly against the lower sheet. When the zipper is unzipped the upper sheet is allowed to move away from the lower sheet to the extent of the expandable flaps or material. However the bed covering system cannot be expanded uniformly to fit with mattresses of different thickness and sizes.

Similarly, as taught in U.S. Pat. No. 7,181,797 issued to Chase on Feb. 27, 2007, discloses is a mattress cover having expandable sidewalls. The mattress cover may enclose a mattress to provide protection against allergens, dust mites, fluids, and other spills and spoils. The mattress cover comprises generally impermeable top and bottom walls, and sidewalls connected at edges between the top and bottom walls. The sidewalls are formed of a double wall construction comprising a generally impermeable inner wall of a fixed height joined at edges to an elastic outer wall. The outer wall stretches and the inner wall extends to accommodate mattresses of different thicknesses. The outer wall can be relaxed and the inner wall retained neatly against the mattress and by the outer wall. An aperture may be provided in the bottom wall for allowing insertion and removal of a mattress and a fastener may be used to close the aperture. Oftentimes the elastic outer wall may become stretched and cannot secure the mattress in a neat manner.

In addition, U.S. Pat. No. 6,088,858 issued to Juster on Jul. 18, 2000, discloses a mattress jacket having an accessible and expandable compartment. The jacket consists of a sidewall closely following the contour of the mattress on which it is placed. The bottom of the sidewall is tucked under the mattress and secured there under. The compartment includes a bottom sheet that is resting on top of the upper surface of the mattress. The sidewall includes a fold that captures a side edge of the bottom sheet. There is a further fold in an upper section of the sidewall of the jacket that is secured to itself and represents an accordion fold that may expand or collapse as the compartment includes more or less of a cushioning material. There is a third fold secured by seaming in a further upper section of the sidewall forming a planar surface confronting the bottom of a cover that may be separably affixed to the same. The compartment can receive any kind is of cushioning pads without having to remove the mattress cap from a mattress on which it is installed. The compartment sides lock the cushioning material in place while providing a smooth aligned balanced surface, even when the bed is flexed. However the mattress jacket may not be designed to fit with mattress having different size and thickness.

Therefore, there is a need for an expandable mattress cover that could be used to cover different sized mattresses including king size, queen size, twin size, xl twin size, full size and California king size. Such a mattress cover could expand and reduce its size by adjusting a fastening means. The fastening means would be non rusting, machine washable and would be concealed from the user's skin to avoid the risk of scratch or other discomfort. Moreover, the expandable mattress cover would provide stiff fit for the mattresses. The present invention accomplishes all these objectives.

SUMMARY OF THE INVENTION

The present invention is a mattress cover. The mattress cover comprises a top sheet, a bottom sheet and a sidewall joining the top sheet and the bottom sheet. A plurality of edges of the sidewall is stitched to the top sheet and the bottom sheet to form a compartment. An expandable means having a hook is attached to the sidewall. An opening is provided on the sidewall for inserting a mattress into the compartment. The expandable means may be adjusted to fit mattresses of different thicknesses inside the mattress cover. A fastening means having a hook is provided to open or close the opening through which the mattress is inserted. The fastening means is adjusted to open the opening before inserting the mattress into the compartment. The mattress is secured in position by adjusting the fastening means to close the opening. The hook is used to clip the expandable means and/or the fastening means onto the mattress cover, via a plurality of arcuate projections that directly contact the mattress cover, when not in use. The mattress cover may form a stiff fit over mattresses having different thicknesses.

The expandable means is attached throughout the length of the sidewall. The expandable means may be any type of fastener such as a zipper. The zipper may have a first zipper strip attached to the sidewall and a second zipper strip attached to the sidewall below the first zipper strip. The first zipper strip and the second zipper strip are placed parallel to each other on the sidewall. When a zipper pull tab of the zipper is pulled, an interlock is formed between the first zipper strip and the second zipper strip. The hook is attached to the zipper pull tab. The effective space inside the compartment can be increased by unzipping the expandable means. The mattress cover is constructed to fit with each different sized mattress. To fit the mattress cover with mattresses having larger thickness, the zipper pull tab of the expandable means may be pulled to release the interlock. The hook attached to the zipper pull tab is used to clip the zipper pull tab onto the mattress cover, when not in use. The fastening means and the expandable means can be operated and kept at a fixed position, when not in use, utilizing the hook. The fastening means and the expandable means may be concealed from user skin to avoid the risk of scratch or other discomfort.

The present invention provides a mattress cover for covering mattresses of different thicknesses. The compartment inside the mattress cover is formed by stitching the top sheet and the bottom sheet to the sidewall. The expandable means attached to the sidewall of the mattress cover is adjusted for covering mattresses of larger thicknesses. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
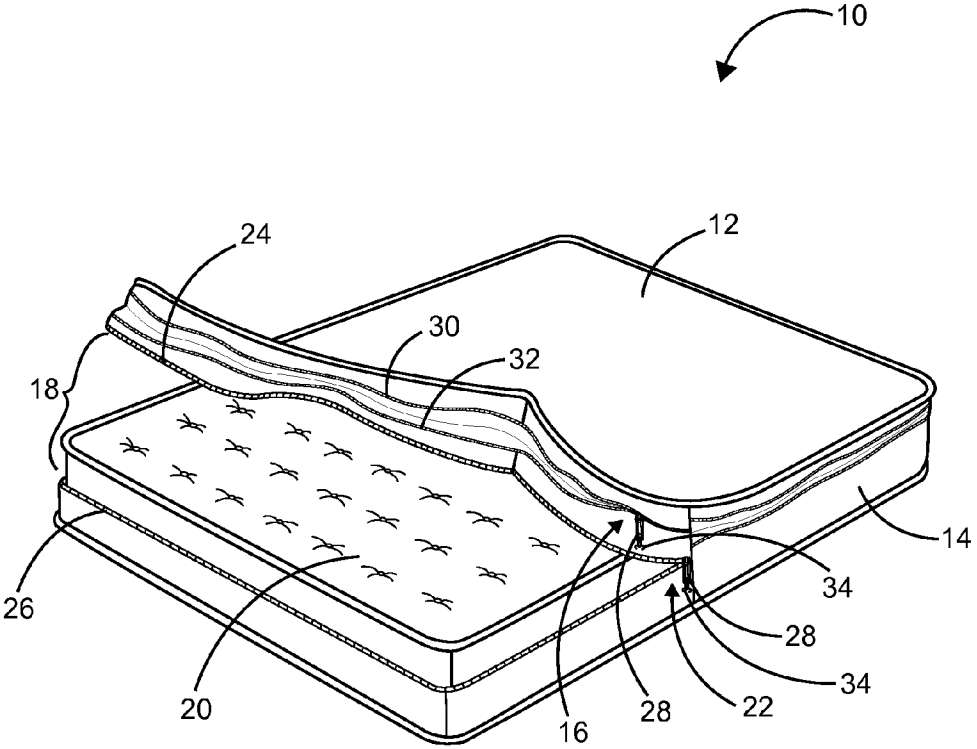
FIG. 1 is a perspective view of a mattress cover for covering mattresses having different thicknesses in accordance with a preferred embodiment of the present invention.

FIG. 1 is a perspective view of a mattress cover 10 for covering mattresses having different thicknesses. The mattress cover 10 comprises a top sheet 12, a bottom sheet (not shown) and a sidewall 14 joining the top sheet 12 and the bottom sheet (not shown). A plurality of edges of the top sheet 12 and the bottom sheet (not shown) are attached to a plurality of edges of the sidewall 14 by stitching to form a compartment (not shown). An expandable means 16 is attached to the sidewall 14. The expandable means 16 is provided with a hook 34. An opening 18 is provided on the sidewall 14 for inserting a mattress 20 into the compartment (not shown). The opening 18 is closable and openable by operating a fastening means 22 attached to the sidewall 14. The fastening means 22 may be fixed at a particular position by utilizing the hook 34. The expandable means 16 may be adjusted to fit mattresses having different thicknesses inside the mattress cover 10.

The top sheet 12 may have a substantially rectangular shape with rounded corners. The bottom sheet (not shown) has substantially the same dimension as that of the top sheet 12. The fastening means 22 can either open or close the opening 18 through which the mattress 20 is inserted. The mattress covers 10 are made/constructed to fit each different mattress size including king size, queen size, twin size, xl twin size, full size and California king size. The fastening means 22 may be selected from any type of attachment means such as a zip fastener 22. The zip fastener 22 includes a top zipper strip 24 and a bottom zipper strip 26, which are parallel to each other and attached to the sidewall 14. A zipper slider having a zipper pull tab 28 brings the top zipper strip 24 and the bottom zipper strip 26 together when pulled and creates an interlock. The fastening means 22 is adjusted to open the opening 18 before inserting the mattress 20 into the compartment. The mattress 20 is secured in position by adjusting the zipper pull tab 28 to create an interlock thereby closing the opening 18.

Figure 2:
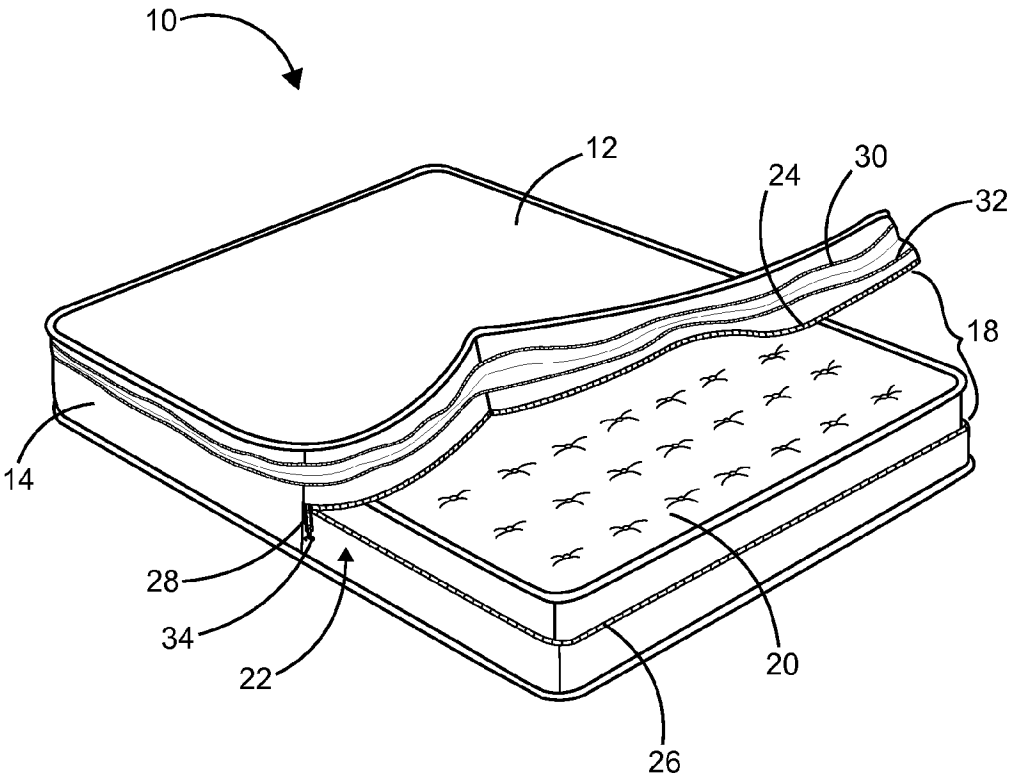
FIG. 2 is a perspective view of the mattress cover.

FIG. 2 is a perspective view of the mattress cover 10. The top sheet 12, the bottom sheet (not shown) and the sidewall 14 may be made of generally impermeable materials. The sidewall 14 may have a width of at least 22 inches. The expandable means 16 is attached throughout the length of the sidewall 14. The expandable means 16 may be any type of fastener such as a zipper 16 which is attached to the sidewall 14. The zipper 16 may have a first zipper strip 30 attached to the sidewall 14 and a second zipper strip 32 attached to the sidewall 14 below the first zipper strip 30. However the first zipper strip 30 and the second zipper strip 32 are placed parallel to one another on the sidewall 14. When the zipper pull tab 28 of the expandable means 16 is pulled the first zipper strip 30 and the second zipper strip 32 creates an interlock.

Figure 3:
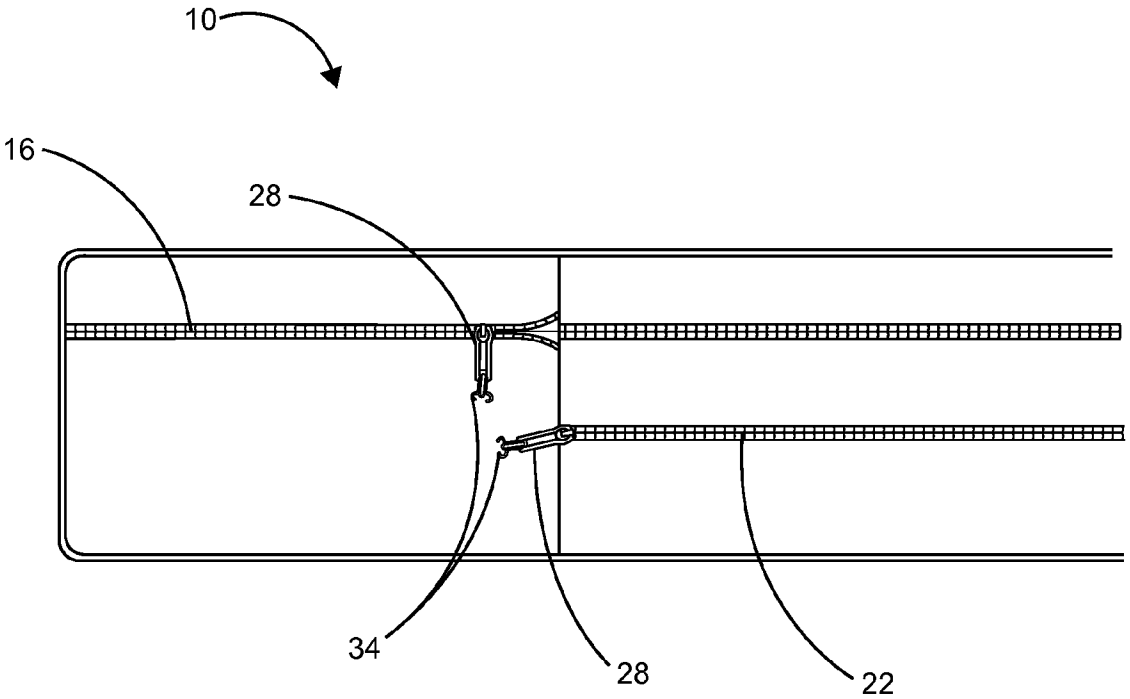
FIG. 3 is an enlarged side view of the mattress cover showing a hook connected to a zipper pull tab.

FIG. 3 is an enlarged side view of the mattress cover 10 showing a hook 34 connected to the zipper pull tab 28. The hook 34 may be connected to the zipper pull tab 28 of the expandable means 16 and the fastening means 22. The mattress 20 may be inserted into the mattress cover 10 through the opening 18. The expandable means 16 may be adjusted depending upon the thickness of the mattress 20. The mattress 20 is secured inside the mattress cover 10 by adjusting the fastening means 22 to close the opening 18. The hook 34 attached to the zipper pull tab 28 is used to clip the zipper pull tab 28 onto the mattress cover 10, when not in use, via a plurality of arcuate projections that directly contact the mattress cover (as shown in FIG. 3, unnumbered, disposed at an end of pull tab 28). Thereby the fastening means 22 and the expandable means 16 can be operated and kept at a fixed position, when not in use, utilizing the hook 34.

In order to fit with mattresses having larger thickness, the zipper pull tab 28 of the expandable means 16 may be pulled in a particular direction to release the interlock thereby expanding the folded portion of the sidewall 14. The expandable means 16 could be positioned at any desired location on the sidewall 14, preferably near the top edge of the sidewall 14. In order to accommodate mattresses of different thicknesses, the mattress cover 10 may be expanded by unzipping the expandable means 16. While unzipping the expandable means 16, a portion of the folded sidewall 14 beneath the zipper 16 becomes stretched. Hence the overall space inside the compartment can be increased by unzipping the expandable means 16. The zipper 16 may run along the sidewall 14 lengthwise once around the sidewall 14 or may run in layers surrounding the sidewall 14. The material of the top sheet 12, the bottom sheet (not shown) and the sidewall 14 may be fabricated from any standard sheet materials such as cotton, linen, flannel or satin. The zipper 16 and the zip fastener 22 are provided to function as an expandable means 16 and the fastening means 22 is preferably manufactured to maintain as an impermeable seal when closed.

Mattresses of various sizes including king size, queen size, twin size, xl twin size, full size and California king size are available in the market. These mattresses may have thicknesses ranging from 4 inches to 18 inches. By using the appropriate mattress cover 10 any particular sized mattress having thickness between 4 inches to 22 inches can be inserted. The fastening means 22, the expandable means 16 and the hook 34 may be selected from non rusting, machine washable materials. The zipper 16 zip fastener 22 for the fastening means 22 and the expandable means 16 may be a plastic zipper or metallic zipper. The fastening means 22 and the expandable means 16 may be concealed from user skin to avoid the risk of scratch or other discomfort.

Figure 4:
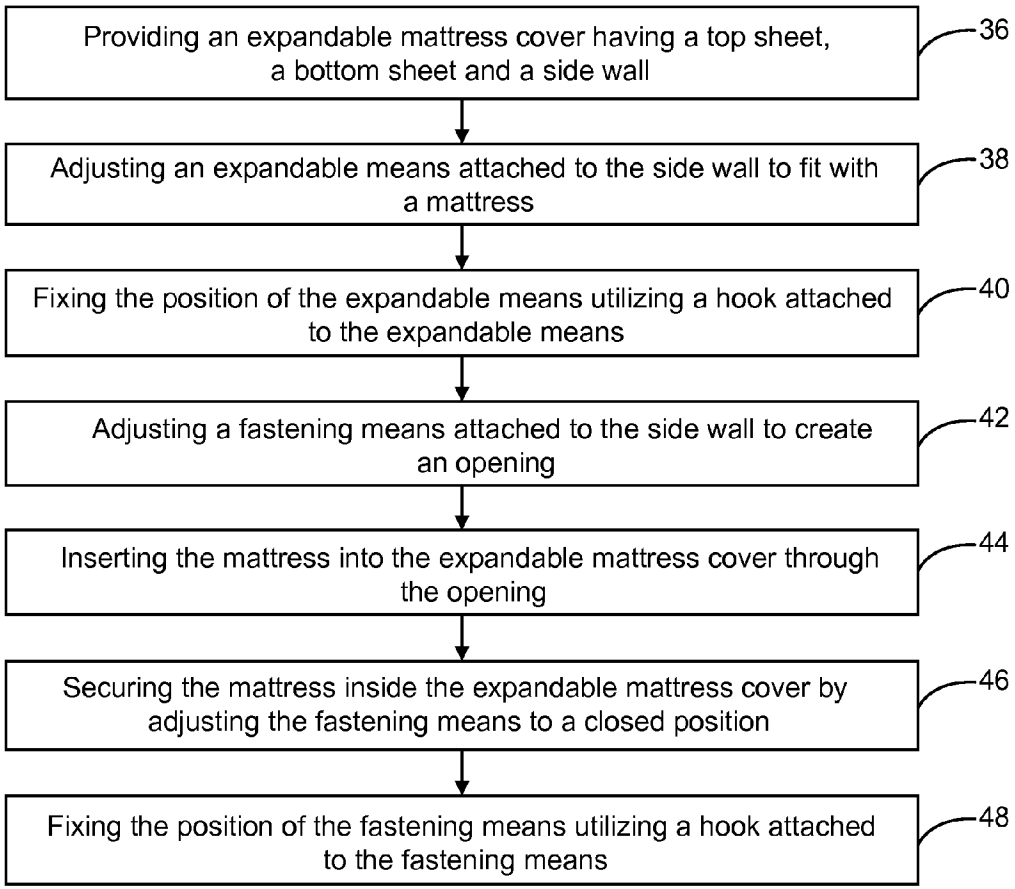
FIG. 4 is an operational flow chart of a method for using the mattress cover in accordance with the preferred embodiment of the present invention.

Referring to FIG. 4, an operational flow chart of the method for using an expandable mattress cover in accordance with the preferred embodiment of the present invention is illustrated. The method initiates by providing the expandable mattress cover having a top sheet, a bottom sheet and a sidewall as indicated at block 36. An expandable means attached to the sidewall of the expandable mattress is adjusted to fit with a mattress as indicated at block 38. The position of the expandable means is fixed utilizing a hook attached to the expandable means as indicated at block 40. In the next step, a fastening means attached to the sidewall is adjusted to create an opening as indicated at block 42. Then the mattress is inserted into the expandable mattress cover through the opening as indicated at block 44. In the next step, the mattress is secured inside the expandable mattress cover by adjusting the fastening means to a closed position as shown in block 46. Finally, as shown in block 48 the position of the fastening means may be fixed utilizing a hook attached to the fastening means.

While a particular form of the invention has been illustrated and described, it will be apparent that various modifications can be made without departing from the spirit and scope of the invention. For example, the expandable means 16 of the mattress cover 10 may be an elastic strip for increasing the compartment area whenever required. The mattress cover 10 may use Velcro or any other fastening means for securing the mattress 20 inside the mattress cover 10. Accordingly, it is not intended that the invention be limited, except as by the appended claims.

What is claimed is:

1. A method for inserting a mattress into an expandable mattress cover, the method comprising the steps of:

a) releasing a first hook, said first hook disposed at an end of a first pull tab, provided with an expandable means from a directly interlocked position with a sidewall of the expandable mattress cover, wherein said directly interlocked position further comprises the first hook directly contacting the sidewall, thereby retaining the first hook and first pull tab in a fixed position;

b) adjusting an expandable means, via a first fastening means, attached to the sidewall of the expandable mattress cover continuously throughout the length of the sidewall to expand the expandable mattress cover;

c) releasing a second hook, said second hook disposed at an end of a second pull tab, provided with a second fastening means from a directly interlocked position with the sidewall, wherein said directly interlocked position further comprises the second hook directly contacting the sidewall, thereby retaining the second hook and second pull tab in a fixed position;

d) adjusting the second fastening means to create an opening for inserting the mattress into the expandable mattress cover easily through a sliding motion;

e) sliding the mattress easily into a compartment formed inside the expandable mattress cover through the opening;

f) securing the mattress inside the expandable mattress cover by continuously adjusting the fastening means to a closed position to close the opening;

g) fixing the position of the second fastening means utilizing the second hook to engage with the sidewall.

2. The method of claim 1 wherein the expandable means may comprise a zipper running throughout the length of the sidewall and hiding beneath a folded portion of the sidewall.

3. The method of claim 1 wherein the first fastening means and the expandable means is concealed from a user's skin to avoid the risk of scratch and other discomfort.

4. The method of claim 1 wherein the expandable means forms an interlock with the sidewall utilizing the first hook.

5. The method of claim 1 wherein the expandable means is kept at a fixed position when not in use by forming the interlock with the sidewall utilizing the first hook.

6. The method of claim 1 wherein the expandable means is pulled in a particular direction to release the interlock formed by the first hook and the sidewall.

* * * * *